United States Patent [19]

Milewski

[11] Patent Number: 4,964,355

[45] Date of Patent: Oct. 23, 1990

[54] FLUSH MOUNTED COLLAPSIBLE CLEAT

[76] Inventor: Charles M. Milewski, 1500 SW. 17th St., Ft. Lauderdale, Fla. 33312

[21] Appl. No.: 54,841

[22] Filed: May 27, 1987

[51] Int. Cl.[5] ..... B63B 21/04

[52] U.S. Cl. ..... 114/218

[58] Field of Search ..... 114/199, 218; 411/160

[56] References Cited

U.S. PATENT DOCUMENTS

| | | | |
|---|---|---|---|
| 1,402,496 | 1/1922 | Hoffman | 114/218 |
| 2,555,805 | 6/1951 | Miller | 114/218 |
| 4,103,725 | 8/1978 | Abe | 411/160 |

FOREIGN PATENT DOCUMENTS

| | | | |
|---|---|---|---|
| 27461 | 3/1930 | Netherlands | 114/218 |

*Primary Examiner*—Sherman D. Basinger

[57] ABSTRACT

A collapsible cleat assembly positionable selectively into a stored position defined by a cleat member disposed into the interior of a cavity integrally formed in a mounting base wherein the cleat member is substantially flush with an outer exposed surface of the mounting base so as not to provide any significant protrusion above the surface of the deck or dock in which the cleat assembly is mounted. The cleat member is selectively pivotal substantially 90 degrees out of the cavity into an operative, upstanding position above the deck or dock surface for attachment and retention of a mooring line or the like and further wherein the mounting base including the cavity is set into a formed recess within the deck surface or dock surface on which the cleat assembly is mounted so as to transfer, at least in part, stresses or focuses to the entire mounting base rather than the connecting structure for securing the cleat movably to the mounting base.

9 Claims, 1 Drawing Sheet

20
10
-20'-
-22-
30
12
7
7
13

6
4
4
30
-32-
42
-20'-
34
-36-
34
42
42
42
35
35

2B
38
35
35
2B 6
5
30
-32-
10
42
42
34
-36-
34
42
42
20
38
38
18
35
35
22

5
10
30
35
20'
20
22

10
32
30
35
24
10
22

24
35
22

30
10
44
44
44
44
12
26
44'
44'
44'
44'
10
14
16
26
26

FLUSH MOUNTED COLLAPSIBLE CLEAT

BACKGROUND OF THE INVENTION

1. Field of the Invention

A cleat assembly capable of being mounted in a recessed configuration on the deck of a marine craft or alternately on a dock to which the craft is secured as by a mooring line or the like wherein a cleat member is selectively positionable between a stored position, flush with the supporting surface and within a cavity of the mounting base of the cleat assembly or alternately in an upright outwardly extending operative position for attachment to the mooring line.

2. Description of the Prior Art

The use of cleats to secure a line either on the deck of a marine craft or alternately on the surface of a dock is well known for the attachment of mooring lines or other lines associated with the operation of the marine craft. Typically, such cleat structures are of a conventional configuration which may vary in size dependent upon their intended use or size of the craft on which they are used. Also, it is conventional in the prior art to fixedly secure these cleat members in an upwardly and outwardly extending position on the surface of the deck of the marine craft or the dock so as to readily present such cleat members in a convenient location for line securement.

One problem associated with the conventional mounting of cleat structures is their outward fixed protrusion providing a continuous safety hazard when not in use. It is common for passengers or crew to trip or stumble over such protruding cleat structures causing injury to themselves as well as the danger of falling overboard during operation of the craft. In order to avoid the problems associated with the fixed location of cleats but recognizing their necessity in the proper operation and/or mooring of a marine craft, the prior art has made attempts to provide cleat structures which are capable of being positioned in a stored, out of the way position or selectively disposed in an operable position. Prior art structures of the type set forth herein are generally represented in the U.S. Pat. Nos. 1,402,496; 4,270,478; and 4,354,445. However, in each of the structures disclosed in the above-referenced patents, the exertion of stress or force on the cleat results in undesirable or relatively excessive forces being exerted on perhaps the weakest portion of the structure.

Accordingly, there is a need in the marine industry for a cleat structure capable of being selectively positioned between an operative and a stored position and which is otherwise structured and configured to transfer forces exerted thereon such as when a mooring line is attached thereto which effectively distributes the "pulling" force throughout a mounting base as well as the cleat structure and its interconnection to the mounting base.

SUMMARY OF THE INVENTION

The present invention relates to a cleat assembly of the type movably positionable and secured to a mounting base so as to be selectively disposed between a stored position and an upstanding operative position. The mounting base includes an outwardly extending flange integrally formed thereon and comprising an outer exposed surface. A cavity is formed in the base in essentially surrounded relation by the outer exposed surface and depending downwardly from the undersurface of the flange. The cavity is dimensioned and configured to receive the cleat member such that it is disposed in a somewhat parallel orientation to the exposed surface of the mounting flange and disposed therebeneath within the interior of the cavity. The relative positions and dimensions of the cleat member and the cavity are such that when in the stored position, as defined above, the cleat member is substantially flush with the exposed surface so as not to present any type of obstruction or hazard to one walking along the surface in which the subject cleat assembly is mounted.

An operative position of the cleat member is defined by it being effectively pivoted or rotated substantially 90 degrees out of its stored position within the cavity so that it extends transversely upright out of the cavity and in substantially perpendicular relation to the outer exposed surface of the flange of the mounting base. In such operative position, the cleat element is disposed for engagement and support of a mooring line or like line required on the marine craft for its operation, such as on a sailing vessel. The cleat preferably comprises two support legs spaced apart from one another wherein their distal end is secured to and pivotal about a mounting pin attached to the mounting base adjacent the cavity and generally below the flange of the mounting base.

A space is specifically provided between the mounting legs for placement of one or more fingers such that the cleat member can easily be removed out of the cavity from its stored position to its operative position. Further, a friction washer having a spring effect serves to interconnect each of the legs to an inner surface of the cavity and in movable relation to the pin to the pin thereby serving to maintain or provide a tendency of the cleat member to maintain its disposition in whatever position it is located. Therefore, the cleat member will not have a tendency to inadvertently fall into the stored position when it is desired to maintain it in its upright operative position.

Another feature of the present invention comprises the securement of the mounting base to the deck surface or dock surface by means of a recess formed in the deck surface or dock surface. The cavity or outer walls of the cavity fit within the recess and the flange is disposed in substantially flush, coplanar relation to the outer exposed surface of the dock surface or deck surface. By virtue of the conformance in configuration of the recess in which the mounting base is formed to the exterior configuration of the cavity, forces will be distributed throughout the mounting base as well as on the cleat structure itself when the cleat structure is secured to a line moored to a dock or any other line used on the craft itself. Securement of the mounting base in the aforementioned manner is accomplished by a plurality of apertures being formed on the base and bolts or like connectors extending through the apertures into an anchored relation in the deck surface or dock surface on which the cleat assembly is mounted. The structure and configuration of the subject cleat assembly serves to distribute the stress load away from the deck and mounting bolts into the solid material mounting base. The relationship and securement of the cleat member to the mounting base will reduce or alleviate some of the force being applied directly to the mounting pin thereby exerting a shearing force thereon. The pulling force to which the cleat is subjected is extended in a fore and aft motion, generally not more than 40 degrees to a parallel pull on the total unit. Any stress present due to this motion is transferred from the base of the cleat against the vertical side of the mounting base rather than the pivot pin.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figures 1, 2, 2A, 2B, 3, 4, 5, 6, 7, 8:
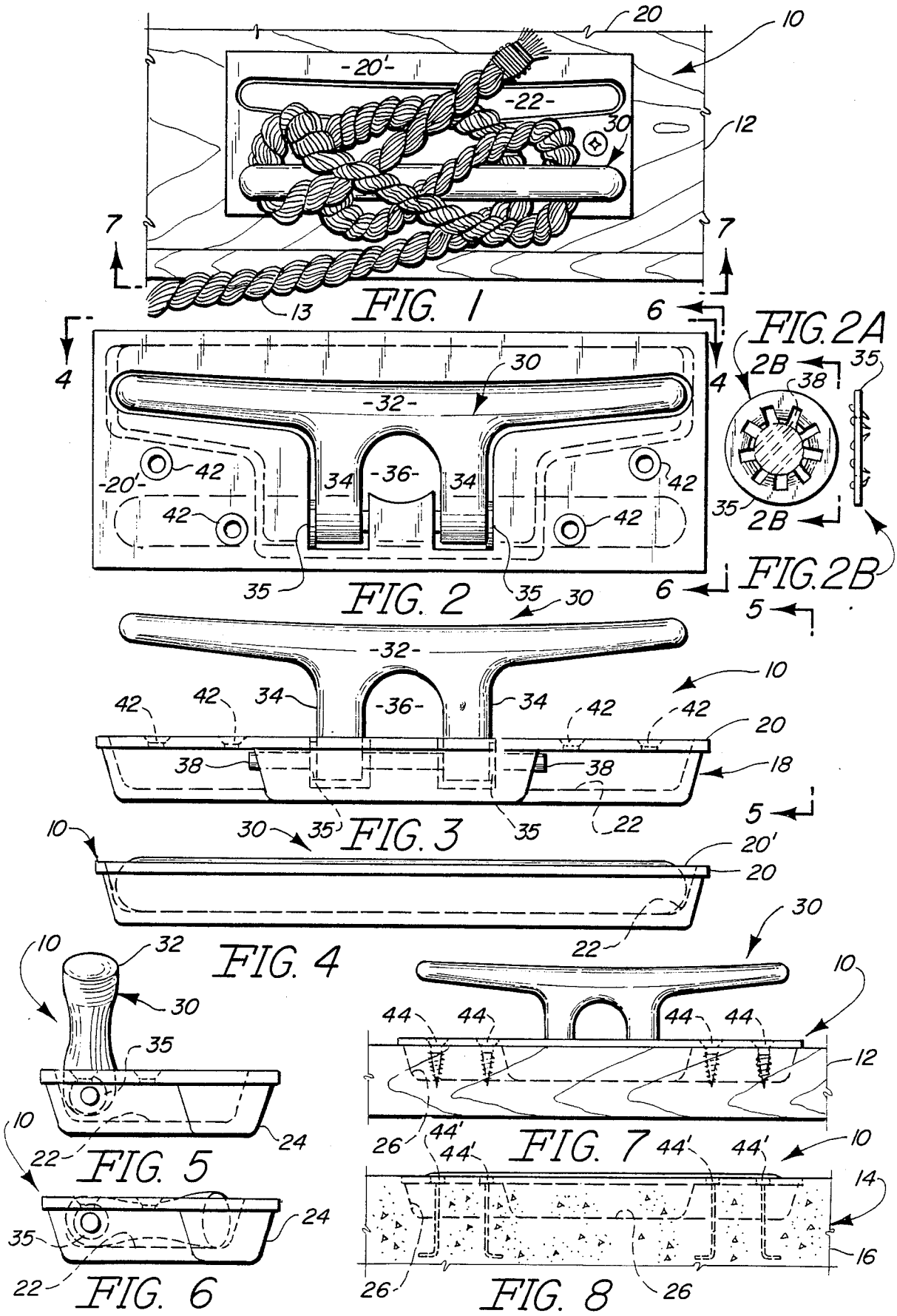
FIG. 1 is a top plan view of the mounting assembly of the present invention secured to and mounted on a deck surface or dock surface with a cleat member thereof in an operative position.
FIG. 2 is a top plan view of the embodiment of FIG. 1 with the cleat member shown in a stored position.
FIG. 2A is a front plan detailed view of a washer structure used to maintain a cleat member in a preferred position.
FIG. 2B is a side view of the embodiment of FIG. 1.
FIG. 3 is a longitudinal side view of the cleat assembly of the present invention with the cleat member shown in operative position.
FIG. 4 is a longitudinal side view along line 4—4 of FIG. 2 with the cleat member shown in a stored position.
FIG. 5 is an end view along line 5—5 of FIG. 3.
FIG. 6 is an end view along line 6—6 of FIG. 2.
FIG. 7 is a longitudinal side view along line 7—7 of FIG. 1 with the cleat member being represented in phantom lines.
FIG. 8 is a longitudinal end view in partial cutaway in section showing the cleat assembly of the present invention mounted in a cementitious material.

As shown in FIGS. 1 through 8, the present invention is directed to a cleat assembly generally indicated as 10 of the type intended to be mounted on the deck 12 of a marine craft or the like and have a line 13 attached thereto. Alternately, the cleat assembly 10 can be mounted in a dock surface 14 formed of a variety of materials including cementitious material 16 (see FIG. 8).

The cleat assembly 10 comprises a mounting base 18 including an integrally formed peripheral flange 20 and a cavity 22 integrally secured to the flange 20 and depending downwardly therefrom such that it extends below the flange as well as an outer exposed surface 20' of the flange. With regard to FIGS. 3, 4 and 6, it is clearly seen that the cavity 22 includes an exterior wall 24 disposed in surrounding relation thereto and defining the boundaries of the cavity 22 at least to a certain extent. An important feature of the present invention is the mounting of the cleat assembly 10 in a manner which requires the formation of a recess 26 within the surface of the deck 12 or dock 14. This is formed generally into the configuration of the exterior wall 24 surrounding the cavity 22 and may be formed as by routing or any other applicable conventional manner. Therefore, the exterior surface of the wall 24 firmly engages the interior surface of the recess 26 providing meaningful and adequate support to the mounting base 18.

The cleat assembly 10 further comprises a cleat member 30 having a conventional upper arm structure 32 and two depending mounting legs 34 spaced from one another by space 36. The distal ends of each legs 34 are pivotally secured to a mounting pin 38 secured adjacent to the cavity 22 and disposed below the mounting flange 20. A spring or friction washer 35 is disposed in functional engagement between the support legs 34 and the inner surface of the cavity or mounting base 18 and around support pin 38 so as to provide sufficient friction between surfaces engaged by washer 35 as shown in FIGS. 2A and 2B and thereby produce a tendency of the cleat member 30 to maintain its upright or alternately its stored position as respectively shown in FIGS. 3 and 2.

As is further shown in FIGS. 4, 6 and 8, the stored position of the cleat member 30 is such as to be substantially flush with the exposed surface 20' of flange 20 thereby eliminating any obstacle over which one could trip when for example the cleat member 30 is in its upright or operative position as represented in FIGS. 1, 3 and 5. Therefore, the depth of the cavity 22 is such as to receive substantially all of the cleat member 30 therein so as to define the stored position such that the cleat member 30 is substantially parallel to the flange 20 and having a majority of the cleat member located below the flange 20 within the cavity. As a practical matter, a minimal amount of the cleat member 30 may in fact protrude above the surface 20' as best shown in FIG. 4. However, the position of FIG. 4 is still considered to be "flush" within the context of the present invention in that it clearly does not present any type of obstacle over which one would trip when walking on the deck or dock surface on which the cleat assembly 10 is mounted. Also as shown in the preferred embodiment herein, the peripheral configuration of the cavity 22 substantially corresponds to the configuration of the cleat member 30.

Actual securement of the cleat assembly 10 to the deck 12 or dock 14 (FIGS. 7 and 8) is accomplished by connecting means comprising a plurality of apertures 42 integrally formed in and extending through the flange 20. Further, a plurality of connectors as at 44 extend through the apertures 42 and are embedded in the material defining the deck 12 or the dock 14 (see FIGS. 7 and 8).

Now that the invention has been described,

What is claimed is:

1. A cleat assembly designed for use on a marine craft or dock structure for the retention of a line and securing the marine craft to the dock, said assembly comprising:

(a) a base formed of a rigid material and of an integral, one-piece construction and including a cavity defining an interior portion of said base, (b) a mounting flange integrally secured to said base and including a substantially planar configuration and an outer exposed surface, said mounting flange extending outwardly from said cavity in continuously surrounding relation about a periphery of said cavity, (c) said cavity comprising a wall structure depending downwardly from said mounting flange and including an inner surface defining interior boundaries of said cavity and an outer surface, (d) a cleat member formed of a one-piece construction and including a support arm and mounting portion integrally secured to one another, (e) said cavity comprising a depth substantially equal to a thickness of said cleat member, said cleat member including one side face thereof being substantially flush with said outer exposed surface of said mounting flange when said cleat is in a stored position within said cavity, (f) a pivot pin securing said cleat to said base and secured to said base beneath said mounting flange and within said cavity and extending substantially parallel to a length of said support arm, (g) said mounting portion pivotally mounted on said pivot pin and including at least one end of said mounting portion disposed immediately adjacent said inner surface of said cavity in cooperative relation thereto, (h) at least one friction member disposed in interconnecting and concurrently engaging relation with both said one end of said mounting portion and said inner surface of said cavity and dimensioned to removably maintain said cleat member in either said stored position or an operative position when initially so positioned, (i) said mounting portion, said inner surface of said cavity and said friction member cooperatively disposed to transfer force exerted on said support arm at least partially to said mounting flange and a remainder of said base when force is exerted on said support arm, (j) said operative position defined by said cleat member protruding outwardly from said cavity above and in substantially upwardly transverse relation to said mounting flange, and (k) said cleat member dimensioned to receive the line thereon when in said operative position.

2. An assembly as in claim 1 further comprising connecting means formed in part on said mounting flange and disposed in cooperative engaging relation to a supporting surface on which said base is mounted.

3. An assembly as in claim 2 wherein sad connecting means comprises a plurality of apertures formed in said mounting flange and extending therethrough and a plurality of connectors positioned through said plurality of apertures into securement with the supporting surface.

4. An assembly as in claim 1 wherein said operative position is defined by said cleat member extending outwardly in substantially perpendicular relation to said outer exposed surface.

5. An assembly as in claim 4 wherein said cavity comprises a corresponding configuration to said cleat member.

6. An assembly as in claim 1 wherein said cavity comprises a corresponding configuration to said cleat member.

7. An assembly as in claim 1 wherein said mounting portion comprises two spaced apart mounting legs each pivotally secured to said pivot pin, said one end cooperatively disposed relative to said friction member defined by an outer end of one of said legs.

8. An assembly as in claim 7 further comprising a spacing between said mounting legs being sufficient to receive a finger of a user therein, whereby said cleat member is removable from said cavity by a finger from said stored position into said operative position.

9. An assembly as in claim 7 further comprising two friction members each disposed in interconnecting relation between an outer end of a different one of said mounting legs and said inner surface of said cavity and in surrounding relation to said mounting pin and dimensioned to movably and frictionally interconnect said cleat member to said mounting pin.

* * * * *